United States Patent [19]

Haessner et al.

[11] Patent Number: 4,986,009

[45] Date of Patent: Jan. 22, 1991

[54] PROCESS FOR DRYING A MATERIAL WEB AND DEVICE FOR THE APPLICATION OF THE PROCESS

[75] Inventors: Winfried Haessner; Georg Kugler, both of Heidenheim; Robert Wolf, Herbrechtingen, all of Fed. Rep. of Germany

[73] Assignee: J. M. Voith GmbH, Heidenheim, Fed. Rep. of Germany

[21] Appl. No.: 321,761

[22] Filed: Mar. 10, 1989

[30] Foreign Application Priority Data

Mar. 10, 1988 [DE] Fed. Rep. of Germany ..... 3807856

[51] Int. Cl.[5] ..... F26B 3/00

[52] U.S. Cl. ..... 34/23; 34/155

[58] Field of Search ..... 34/113, 114, 115, 116, 34/117, 23, 155

[56] References Cited

U.S. PATENT DOCUMENTS

| | | | |
|---|---|---|---|
| 3,435,538 | 4/1969 | Hargett | 34/114 |
| 3,503,139 | 3/1970 | Mahoney | 34/111 |
| 4,064,637 | 12/1977 | Lindgren | 32/122 |
| 4,416,070 | 11/1983 | Vedenpa et al. | 34/114 |
| 4,502,231 | 3/1985 | Fissmann et al. | 34/114 |
| 4,516,330 | 5/1985 | Eskelinen | 34/114 X |
| 4,625,430 | 12/1986 | Aula et al. | 34/13 |
| 4,625,434 | 12/1986 | Karlsson et al. | 34/122 |
| 4,821,429 | 4/1989 | Sieberth | 34/114 |
| 4,881,327 | 11/1989 | Hauser et al. | 34/114 |

FOREIGN PATENT DOCUMENTS

| | | |
|---|---|---|
| 233941 | 6/1964 | Austria . |
| 308524 | 7/1973 | Austria . |
| 3216614 | 12/1986 | Fed. Rep. of Germany . |
| 3623971 | 7/1988 | Fed. Rep. of Germany . |
| WO83/00514 | 2/1983 | PCT Int'l Appl. . |

*Primary Examiner*—Henry A. Bennet

*Attorney, Agent, or Firm*—Jeffers, Hoffman & Niewyk

[57] ABSTRACT

Process and device for drying a material web which together with a backing belt alternately runs across heatable drying cylinders which are contacted by the material web and across guide rolls contacted by the backing belt. At the travel section of the material web from one drying cylinder to the next, drying air is fed to the material web in relatively narrow blow zones. Located between the narrow blow zones are relatively wide steam release spaces from which the water vapor-laden drying air is removed.

26 Claims, 2 Drawing Sheets

10
19
9
8
H
11
12
13
14
38
40
41
43
7
21
22
23
24
a
b
24a
15
25
50
52
16
26
51
17
27
18
28
9
31
39
20
42
29
30
39

PROCESS FOR DRYING A MATERIAL WEB AND DEVICE FOR THE APPLICATION OF THE PROCESS

BACKGROUND OF THE INVENTION

The invention concerns a process for drying a material web, specifically a paper or cardboard web, where the material web along with a preferably porous backing belt runs alternately across contact zones on heatable rolls contacted by the material web and across guide rolls which are contacted by the backing belt and where in the sections of the web travel contained between two contact zones drying air is supplied to the free web surface. Additionally, the invention concerns a device for the application of this process.

The invention is based on a prior process and a prior drying apparatus serving the application of the prior process where the material web runs together with the backing belt alternately across upper and lower rolls, for instance drying cylinders. The material web is supported along the entire way through the drying apparatus by the backing belt, so that the material web need not run freely from one roll to another, except perhaps at the exit from the drying apparatus.

Such drying apparatuses or "drying groups" have proved themselves specifically in paper machines. They are used primarily in the initial area of the drying process, where the paper web is still rather moist and thus has only a low inherent strength. Prior drying apparatuses of this type have been described in the following documents: U.S. Pat. No. 3,503,139; U.S. Pat. No. 4,064,637; U.S. Pat. No. 4,625,434; WO 83/00514; and German Patent disclosure No. 35 20 070 (equivalent to U.S. Pat. No. 4,625,430).

In all of these prior drying apparatuses, supplying the heat to the paper web to be dried takes place primarily in the contact zones, that is, by direct heat transfer from the outer cylinder surface of the heatable rolls (preferably of the steam-heated drying cylinders) to the paper web. Additionally, drying air is fed in these prior drying apparatuses (in a more or less intensive way) to the exposed web surface. This always occurs in the sections of the web travel which are contained between two contact zones. The objective of this arrangement is to improve or hasten the drying process. According to WO 83/00514, for instance, hot air blowing boxes are provided for supplying drying air in the area of the so-called suction guide rolls. These latter serve to hold the paper web on the backing belt. The drying air supplied through the hot air blowing boxes can absorb part of the steam released from the paper web. Details concerning removal of the drying air laden with steam are not taught in WO 83/00514.

Under previously customary conditions, i.e., specifically at the previously customary maximum paper machine speeds in the order of about 1,000 to 1,200 m/min, the prior drying methods and drying apparatuses have yielded more or less satisfactory results. Said maximum operating speeds apply to the production of graphic papers in particular. The production of tissue papers already proceeds today at operating speeds up to about 1,900 m/min, but using different drying methods.

Recently, maximum operating speeds considerably higher than heretofore are also being sought in the production of graphic papers. Attempts are being made to raise the maximum operating speed to 1,500 m/min and even higher. To accomplish this goal, the prior drying methods and drying apparatuses need to be improved in many respects, as follows.

1. The specific drying capacity must be increased. The objective in this is to have the length of the drying apparatus not significantly exceed the previously customary dimensions, seeking rather a shortening of the overall length.

2. The efficiency or economy of the drying process must be improved so as to keep the energy consumption within reasonable limits.

3. The so-called run efficiency (runability) of the drying apparatus should be maximally high, i.e., downtimes caused by any paper web breaks should be kept as low as possible.

4. In case a web break still occurs now and then, provisions need to be made that the accruing scrap can be removed with as little risk as possible.

5. In the start-up or restart of the paper machine, the threading of the paper web (which, as is generally known, must take place at the full operating speed) must take place automatically at high reliability.

6. The already known cross profile control in drying (by subdivision of the drying air influx in individually controllable partial flows) should continue to be possible and made still more effective.

The problem underlying the invention is to improve the initially described drying process and the pertaining drying apparatus to the effect that the operating speed can be raised considerably as compared to before and that, at the same time, the above-stated requirements will be met extensively.

Austrian patent No. 308,524 describes a drying process of a different category. There, the paper web passes without a backing belt over a single drying cylinder. Hence, there is only a single contact zone in which the paper web contacts the drying cylinder with its one side. Within this contact zone, drying air is supplied to the other side of the paper web (in the area of pressure chambers). Located between two pressure chambers each is a suction opening through which steam-laden drying air can be removed.

SUMMARY OF THE INVENTION

For the drying process and pertaining drying apparatus, the problem underlying the invention is solved through the features the present invention. Inventionally, provisions are made that in the areas outside the contact zones a relatively strong jet of air is directed at the paper web several times in succession and in narrow drying air blowing zones. It is essential that these drying air blowing zones be relatively narrow in the direction of web travel and that a relatively large spacing be provided between two adjacent drying air blowing zones, so that a large-volume (i.e. relatively wide in the direction of web travel) evaporating space exists in between.

Thus, it is not necessary to feed a maximum volume of drying air between the contact zones of the material web. Instead, a few strong air jets, spaced from one another (and preferably opposing the direction of web travel), are sufficient. These are able to strip or burst the boundary layer that rides along with the material web and consists of an air/steam mixture. Stimulated thereby in succession is the repeated steam release from the paper web, and the newly created boundary layer is again stripped or burst. The vapor release spaces which are wide in the direction of web travel enable a quick removal of the releasing clouds from the paper web. This can be aided by passing the releasing clouds through venting ducts, either solely under the pressure of the supplied blowing air or also through additional suction.

With respect to Austrian Patent No. 308,524, the object of the application differs primarily in that the paper web runs together with a backing belt from one contact zone to the next contact zone, that the drying air is supplied between two contact zones of that paper side which previously was in contact with the drying cylinder, and in that the width of the drying air blowing zones is only a small fraction of the width of the evaporating spaces contained in between (measured in the direction of web travel).

Each of the drying air blow zones is relatively narrow in the direction of web travel and may in the simplest cases be fashioned as a blow slot that extends across the machine width and forms the discharge of a blow slot nozzle. However, the blow zone may be fashioned also as a number of successive blow slots, for instance for reasons of stability. The use of a number of hole type nozzles is also possible. In special cases, the blow zone may be formed also by two blow slots or blow slot rows or hole rows which in the direction of web travel are arranged successively and closely spaced. Nevertheless, the width of the entire blow zone in the direction of web travel should be made as narrow as possible.

As already mentioned above, the discharge direction in the narrow blow zones should preferably be opposite to the direction of web travel. The exact selection of the blow direction depends on the speed of travel of the paper web and on the flow velocity of the drying air flow through the blowing orifices. The objective is that the individual drying air jet will be maximally entrained as it impinges on the paper web, i.e., will be completely deflected in the direction of web travel. In other words, the impinging drying air jet is supposed to form at the impinging point, (or, in the case of an areal jet, at the impinging line) a "wall" for the boundary air layer carried along by the paper web. This is to strip the boundary layer that consists of an air/steam mixture as completely as possible from the paper web. Behind the impinging point, the entrained drying air forms a new boundary layer that absorbs water vapor.

Due to the fact that air blade type drying air jets and evaporation zones alternate several times behind each contact zone in the described manner (in the direction of web travel), a considerably more intensive steam release from the material web than heretofore is taking place across a specific length of web travel, and thus also a more intensive cooling of the paper web is taking place. The intensive cooling of the paper web is aided by using drying air which is heated relatively little (preferred temperature range between 60° and 130° C). The result of the intensive cooling is that the material web absorbs in the next contact zone a considerably greater amount of heat. In other words, the specific drying capacity is considerably increased. Due to this fact, the paper machine can be run at a higher operating speed and/or the overall length of the drying apparatus can be shortened.

In addition, the drying cross profile can be controlled better by subdividing the drying air flows fed to the material web across the width of the material web in individually controllable partial flows.

Basically, the invention is applicable in all drying apparatuses where the material web runs together with a backing belt alternately across upper and lower rolls. Both the upper and lower rolls may be fashioned as heatable drying cylinders. Preferably, however, either only the upper or the lower rolls are designed as heatable drying cylinders. The rolls which in this case are not heatable are preferably suction rolls. Also relevant are suctionless guide rolls whose cylinder surface may be smooth or provided with peripheral grooving.

To increase runability, it is desired to keep the free sections of travel of the material web (and backing belt) from one roll to the next as short as possible. Additionally, it is desired to arrange in the first drying group, where the material web to be dried is still rather moist and thus has only a low inherent strength, the heatable drying cylinders that make direct contact with the material web in the upper row and the guide rolls in the lower row. As a result, in case of any web break, the scrap paper can run off toward the bottom without causing a problem. The required quality of the finished paper web permitting, all of the drying groups of a paper machine may be designed this way. The disadvantage is that only one side of the material web is making contact with the heatable drying cylinders. If it is desired that the other side of the material web make contact also with the heatable drying cylinders, an inverted arrangement relative to the first drying group is chosen in the second drying group.

Taking into account that in the first drying group (with the upper cylinders heatable) scrap paper from the lower guide rolls occasionally runs off downwardly, it proves to be suitable to arrange the blow zones and the evaporation spaces contained between them not on the circumference of the guide rolls but at the travel sections of the material web between the upper and lower rolls. The travel section of the material web that is contained immediately behind the preceding contact zone and extends downward is primarily relevant, for this inventional measure primarily hastens the steam release from the moist paper web heated in the contact zone. However, drying air may be blown additionally also at the upward-running paper web, for instance by supplying drying air through the hollow support beam of a scraper or in accordance with the teaching of the same-priority German patent application No. P 38 07 858.9.

By virtue of the described arrangement of the blow zones, the vertical spacing between the axes of rotation of the rolls of the upper and lower rows needs to be made relatively large in the first drying group, so as to obtain sufficient space for the blow zones and steam release spaces This might be viewed as a disadvantage because the material web, still moist, is due to its natural weight stressed the higher the greater distance it travels outside the contact zones. Owing to the invention, however, the risk of overstressing of the still moist paper web is eliminated by blowing drying air repeatedly at the material web and thus bringing it into intimate contact with the backing belt. The drying air blown at the web generates a certain pressure within the pockets contained directly below the heatable drying cylinders. This is true also when venting ducts are available, because part of the supplied drying air will always escape into the pocket. A further increase of pressure in the pocket can be achieved by the above-mentioned additional feeding of drying air to the upward travel section of the material web.

When choosing the arrangement with the heatable cylinders at the bottom in the second drying group, a very small vertical spacing can be chosen between the roll axes of the upper and lower rows. For here it is possible to arrange the blow zones at the upper half of the circumference of the upper guide rolls. In other words, the free travel sections of the material web from one roll to the next are not needed for accommodating the blow zones and steam release spaces.

Further advantages of the invention and embodiments will be described hereafter with the aid of the drawing.

DESCRIPTION OF THE PREFERRED EMBODIMENT

Figure 1:
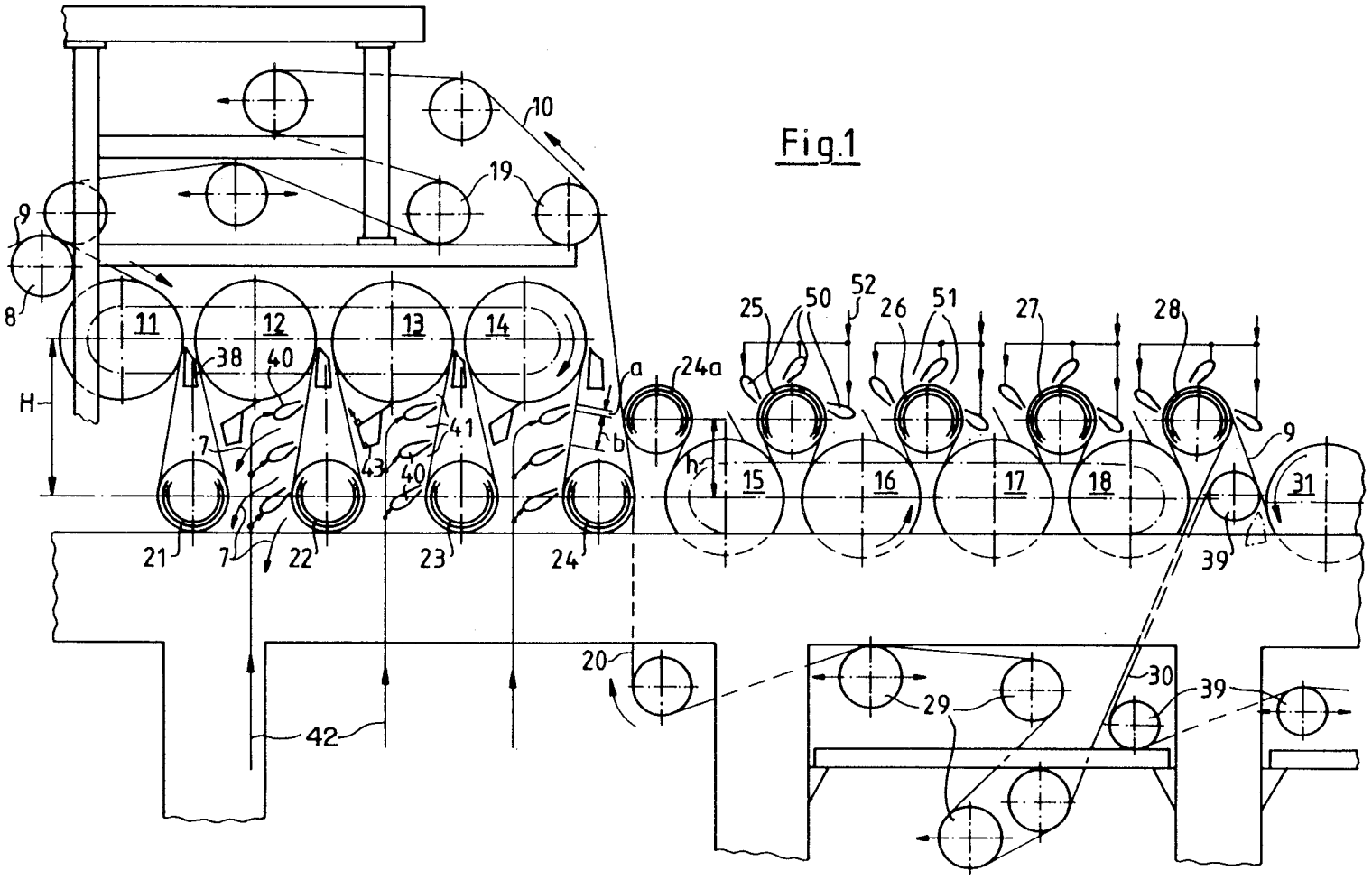
FIG. 1 is a schematic side elevation of a drying apparatus consisting of two drying groups.

The drying apparatus illustrated in FIG. 1 is part of a paper machine. The paper web 9 to be dried, in the illustrated embodiment, runs through the drying apparatus from left to right. A first drying group comprises four upper, heatable drying cylinders 11 through 14 and four lower suction felt guide rolls 21 through 24.

A paper guide roll 8 transfers the paper web 9 to an endless backing belt 10, which preferably is fashioned as a porous wire belt ("drying wire"). Together with the backing belt 10, the paper web 9 meanders through the drying group, i.e., alternately across the drying cylinders 11 through 14 and across the suction guide rolls 21 through 24. From the last suction guide roll 24, the backing belt 10 runs across several guide rolls 19 back to the paper guide roll 8. At the departure point from each drying cylinder 11–14, the paper web 9 is sucked onto the backing belt 10 by a known web stabilizer 38 (see, for instance, U.S. Pat. No. 4,502,231). In a variation from FIG. 1, such a web stabilizer may also extend farther downward, for instance toward the adjacent suction guide roll 21.

The second drying group comprises four lower heatable drying cylinders 15 through 18 and five upper suction guide rolls **24*a* and 25 through 28. Passing through this drying group is as well a continuous backing belt 20, which from the last suction guide roll 28 runs across several guide rolls 29 back to the first suction guide roll 24*a*. This latter suction guide roll 24*a* receives the paper web from the backing belt 10. At the end of this second drying group, i.e., on the last suction guide roll 28, the paper web 9 transfers for the first time in the form of a free paper train to the next drying group. Visible of that group are only a drying cylinder 31, a backing belt 30 and several guide rolls 39**.

In the first drying group, the invention provides for increasing the specific drying capacity for the following drying group. Below the drying cylinders 12, 13 and 14, on each downward travel section of the paper web 9 and the backing belt 10, three blow nozzles 40 are arranged one above the other. These are illustrated in FIG. 1 only schematically. The three superposed blow nozzles 40 each are connected to a common drying air supply line 42. Each blow nozzle 40 extends crosswise through the entire drying apparatus. For the discharging drying air, each blow nozzle features either a row of hole type nozzles or, preferably, a row of slotted nozzles. Best results are attained when the drying air is blown at the paper web 9 in the fashion of an air blade and, additionally, obliquely opposite to the direction of web travel.

It is important that in the area between a drying cylinder, for instance 12, and a suction guide roll, for instance 22, only few, narrow blow nozzles 40 be provided. Additionally, it is important that large spaces 41 remain between adjacent blow nozzles, and between the drying cylinder 12 and the uppermost blow nozzle. Each of these spaces 41 forms a steam release space capable of absorbing the moist air that releases from the paper web 9 removing it downward (arrows 7). Additionally, suction channels may be provided for the moist air. For clarity, these have been omitted in the drawing. The clearance of the blow nozzles 40 is marked a while the width of one of the steam release spaces 41 is marked b, both measured in the direction of web travel. The ratio a/b should amount to maximally 1/20. Much smaller values are desirable, however, namely between 1/50 and 1/200. Additionally, blowing orifices may be provided on the support beam 43 of a scraper, which orifices pass drying air at the paper web 9 that runs upward.

Similar blow nozzles 50 are provided in the second drying group. But these are distributed now across the upper half of the circumference of the suction guide rolls 25 through 28. For instance, three blow nozzles 50 are combined to a group on each suction guide roll and connected to a common drying air feed line 52. In the direction of travel, the blow nozzles 50 are again very narrow, so that relatively wide steam release spaces 51 can be provided between each two blow nozzles in the direction of web travel.

Figure 2:
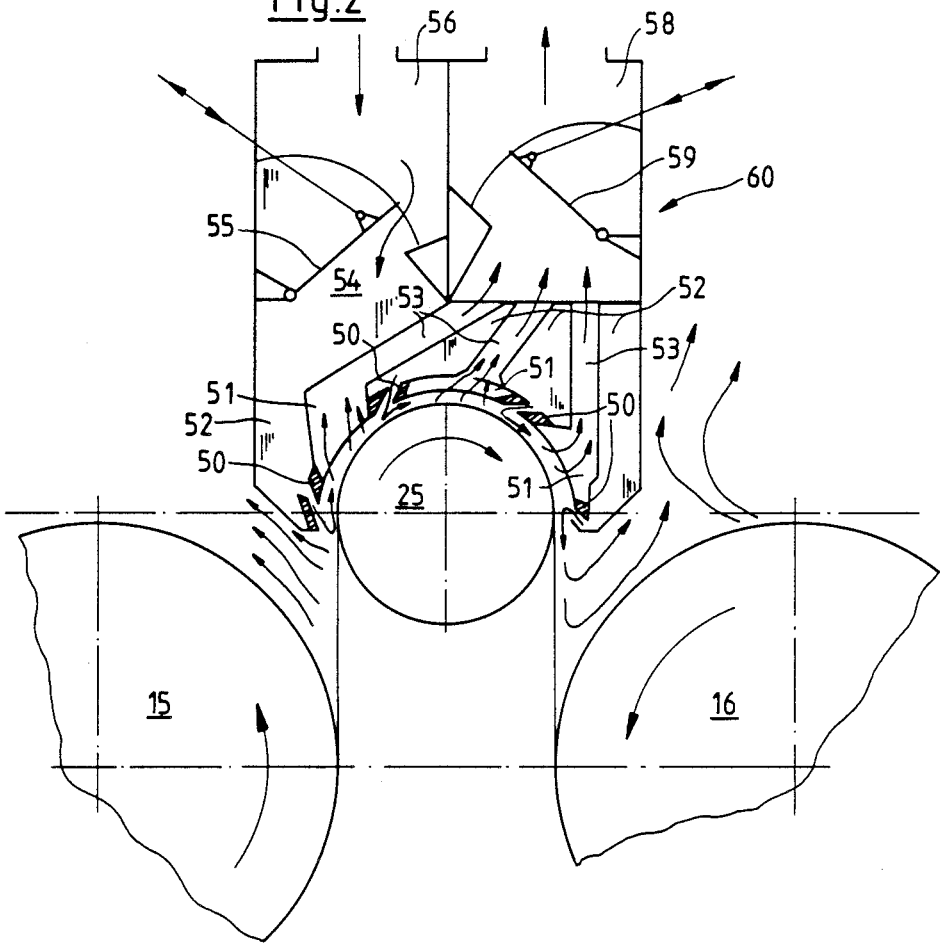
FIG. 2 shows a blow box arranged on a guide roll, in cross section.

According to FIG. 2, each blow nozzle group, which here comprises four blow nozzles 50, can be integrated in a blow box 60 along with the intervening steam release spaces 51 and with feed channels 52, moist air removal channels 53 and a machinewide exhaust air chamber 58. The feed channels 52 may be subdivided within the box, by partitions 54, in several zones that are distributed across the web width and of which each communicates through a controllable damper 55 with an antechamber 56 that extends across the entire machine width. This enables a control of the cross profile in drying (i.e., the distribution of the remaining moisture content of the paper web transverse to the direction of web travel), preferably in the sense that the drying cross profile is maximally uniform. To that end it may be favorable to subdivide into zones also the steam release spaces 51 and the moist air venting channels 53, through partitions, and provide each of the zones with a controllable damper 59.

Such a blow box is preferably mounted movably, so that in the case of a paper web break it can be quickly removed upwardly. Such a safety measure is not required in the first drying group, because the blow zones 40 and steam release spaces 41 are arranged here at web travel sections of approximately vertical extension. Here, in the event of any paper web break, the scrap paper can run off without problem toward the bottom. It is necessary though to make the vertical distance H between the drying cylinder axes and the suction guide roll axes in the first drying group considerably greater than the corresponding vertical distance h in the second drying group.

Figure 3:
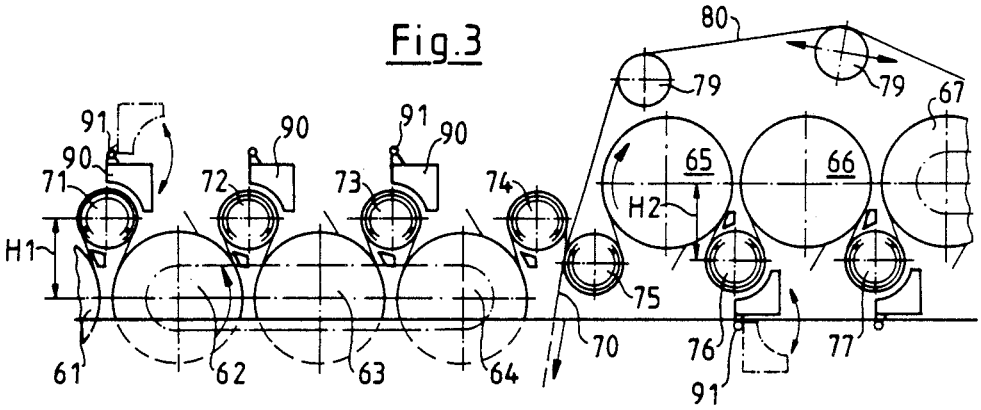
FIG. 3 illustrates an alternative to the apparatus of FIGS. 1 and 2.

FIG. 3 shows an arrangement that varies hereof, where the said vertical spacings, now marked H1 and H2, are approximately equal in both drying groups. Visible in one of the two drying groups are four lower, heatable drying cylinders 61–64 and four upper suction guide rolls 71–74. The continuous backing belt running across these drying cylinders and suction guide rolls is marked 70. It transfers the paper web to be dried, behind the suction guide roll 74 to the drying wire 80 of the next drying group. Of this latter, there are visible three upper drying cylinders 65, 66 and 67, three lower suction guide rolls 75, 76 and 77 and two additional guide rolls 79. Schematically illustrated are several blow boxes 90 which basically have the same design as the blow box 60 shown in FIG. 2. In variation from FIG. 2, each of the blow boxes 90 envelopes the pertaining suction guide roll only across approximately one-fourth its circumference, and at that, preferably in the second half of the zone looped by the backing belt 70 or 80. (The term "second half" relates to the direction of wire travel.) Each of the blow boxes 90 is mounted on pivots 91, so that the upper blow boxes can be swung up and the lower blow boxes down (as indicated in FIG. 3 by dash-dot lines). A not illustrated control device can ensure that the removal of the blow boxes 90 from the suction guide rolls will take place automatically in the event of any paper web break.

An inventionally designed drying group, for instance the one with upper drying cylinders 11 through 14 as illustrated in FIG. 1 and/or the drying group with lower drying cylinders 15 through 18 as illustrated as well in FIG. 1, may be combined with at least one drying group of different design. For instance, a conventional design with two drying cylinder rows and an upper and a lower backing belt may be provided as subsequent drying group. Also possible is a preceding or following drying group which is designed according to the teaching of the same-priority German patent application No. P 38 07 858.9.

What is claimed is:

1. Process for drying a material web comprising:

passing the material web, along with a porous backing belt, alternately across contact zones on heatable rolls which are contacted by the material web and across the guide rolls which are contacted by the backing belt such that a free web surface exists in a section of web travel contained between adjacent contact zones;

supplying drying air from outside each contact zone to the free web surface in drying air blow zones which in the direction of web travel are relatively narrow, with the drying air blow zones alternating in the direction of web travel with steam release spaces which in the direction of web travel are relatively wide, with the ratio of the length of each drying air blow zone to the length of each steam release space being maximally 1/20, such that the material web outside the contact zones repeatedly and alternately passes by drying air blow zones and steam release spaces.

2. Process according to claim 1, in which the drying air is slightly preheated, having a temperature in the range between 60° C. and 130° C.

3. Process according to claim 1, in which the drying air in each individual drying air blow zone is blown at the material web in the fashion of an air blade, as an areal jet.

4. Process according to claim 1, in which the blowing air is blown at the material web in a direction opposite to the direction of web travel.

5. Process according to claim 2, in which the blowing air is blown at the material web in a direction opposite to the direction of web travel.

6. Process according to claim 1, in which the drying air flowing to each individual drying air blow zone is subdivided across the width of the material web into individually controllable partial flows.

7. Process according to claim 4, in which the drying air flowing to each individual drying air blow zone is subdivided across the width of the material web into individually controllable partial flows.

8. Process according to claim 1, in which the drying air from the drying air blow zones, after having become laden with water vapor from the material web, is removed from the steam release spaces through a venting channel.

9. Process according to claim 2, in which the drying air from the drying air blow zones, after having become laden with water vapor from the material web, is removed from the steam release spaces through a venting channel.

10. Process according to claim 6, in which the drying air from the drying air blow zones, after having become laden with water vapor from the material web, is removed from the steam release spaces through a venting channel.

11. Process according to claim 8, in which the removal of drying air takes place through a venting channel which is subdivided across the width of the paper web.

12. Device for drying a material web comprising:

a plurality of heatable rolls arranged in a row;

a plurality of guide rolls arranged in a row generally parallel to that of the heatable rolls;

a backing belt which together with the material web meanders alternately across the heatable rolls and across the guide rolls, the heatable rolls each being contacted by the material web and forming a contact zone, the guide rolls each making contact with the backing belt;

a drying device arranged in an area outside the contact zones and including means for feeding drying air at the surface of the material web in several blow zones which in the direction of web travel are relatively narrow and in the direction of web travel are arranged successively, said blow zones extending transverse to the direction of web travel;

said drying device including steam release spaces arranged on both ends of each blow zone in the direction of web travel, said steam release spaces being relatively wide in the direction of web travel, with the ratio of the width of an individual blow zone to the width of an individual steam release space, each measured in the direction of web travel, being maximally 1/20; and means for removing water vapor-laden drying air from the steam release spaces.

13. Device according to claim 12, in which the ratio of the width of an individual blow zone to the width of an individual steam release space, each measured in the direction of web travel, is in the range 1/50 to 1/200.

14. Device according to claim 12, in which the drying air in the blow zones is blown in a direction opposite to the direction of web travel.

15. Device according to claim 12, in which the heatable rolls are arranged in a lower row and the guide rolls are arranged in an upper row, and the blow zones are arranged at the upper half of the circumference of the guide rolls.

16. Device according to claim 14, in which the heatable rolls are arranged in a lower row and the guide rolls are arranged in an upper row, and the blow zones are arranged at the upper half of the circumference of the guide rolls.

17. Device according to claim 15, in which the blow zones and steam release spaces provided on each individual guide roll are combined in a box that covers at least the top half of the circumference of the guide roll, and including means for mounting the box to permit the box to be lifted off upwardly.

18. Device according to claim 12, in which the heatable rolls are arranged in an upper row and the guide rolls are arranged in a lower row, and the blow zones are arranged predominantly on travel sections of the material web that run downward.

19. Device according to claim 18, in which the blow zones and at least one steam release space are combined in a box.

20. Device according to claim 19, in which lines for supplying and lines for removal of drying air are connected to the box from below.

21. Device according to claim 18, and further including a scraper arranged on the underside of at least one of the heatable rolls and serving as an additional drying air supply device, the scraper having blow openings that are directed at a travel section of the material web that extends upward.

22. Device according to claim 19, and further including a scraper arranged on the underside of at least one of the heatable rolls and serving as an additional drying air supply device, the scraper having blow openings that are directed at a travel section of the material web that extends upward.

23. Device according to claim 12, and further including a first drying group in which the heatable rolls are arranged in an upper row and the guide rolls are arranged in a lower row, and a second drying group in which the heatable rolls are arranged in a lower row and the guide rolls are arranged in an upper row, wherein the vertical spacing between the roll axes of the upper and the lower row in the first drying group is greater than in the second drying group.

24. Device according to claim 14, and further including a first drying group in which the heatable rolls are arranged in an upper row and the guide rolls are arranged in a lower row, and a second drying group in which the heatable rolls are arranged in a lower row and the guide rolls are arranged in an upper row, wherein the vertical spacing between the roll axes of the upper and the lower row in the first drying group is greater than in the second drying group.

25. Device according to claim 12, having at least two drying groups wherein in one of the drying groups heatable rolls are arranged in a lower row and guide rolls in an upper row, and in an adjacent drying group, heatable rolls are arranged in an upper row and guide rolls in a lower row, in which the vertical spacings between the roll axes of the upper and lower row are in both drying groups substantially equal, and including blow boxes arranged on the lower guide rolls which cover only approximately one-fourth of the circumference of the guide roll, and a device for removing the blow box from the guide roll.

26. Device according to claim 13, having at least two drying groups wherein in one of the drying groups heatable rolls are arranged in a lower row and guide rolls in an upper row, and in an adjacent drying group, heatable rolls are arranged in an upper row and guide rolls in a lower row, in which the vertical spacings between the roll axes of the upper and lower row are in both drying groups substantially equal, and including blow boxes arranged on the lower guide rolls which cover only approximately one-fourth of the circumference of the guide roll, and a device for removing the blow box from the guide roll.

* * * * *